US010256026B2

(12) United States Patent
Frey et al.

(10) Patent No.: US 10,256,026 B2
(45) Date of Patent: Apr. 9, 2019

(54) TRANSFORMER COMPONENT WITH SETTING OF AN INDUCTANCE

(71) Applicant: EPCOS AG, München (DE)

(72) Inventors: Jürgen Frey, Heidenheim (DE); Matthias Haubner, München (DE); Günter Feist, Gingen/Fils (DE)

(73) Assignee: EPCOS AG, Munich (DE)

( * ) Notice: Subject to any disclaimer, the term of this patent is extended or adjusted under 35 U.S.C. 154(b) by 57 days.

(21) Appl. No.: 15/039,120

(22) PCT Filed: Oct. 29, 2014

(86) PCT No.: PCT/EP2014/073255
§ 371 (c)(1),
(2) Date: May 25, 2016

(87) PCT Pub. No.: WO2015/082138
PCT Pub. Date: Jun. 11, 2015

(65) Prior Publication Data

US 2017/0053730 A1 Feb. 23, 2017

(30) Foreign Application Priority Data

Dec. 4, 2013 (DE) ..... 10 2013 113 481

(51) Int. Cl.
*H01F 21/00* (2006.01)
*H01F 3/14* (2006.01)
(Continued)

(52) U.S. Cl.
CPC ..... *H01F 27/263* (2013.01); *H01F 3/14* (2013.01); *H01F 17/043* (2013.01);
(Continued)

(58) Field of Classification Search
CPC ..... H01F 21/065; H01F 21/06; H01F 3/14
See application file for complete search history.

(56) References Cited

U.S. PATENT DOCUMENTS 1,869,364 A * 8/1932 Allison ..... H01F 29/10 336/133
2,628,342 A * 2/1953 Taylor ..... H04M 1/02 336/107

(Continued)

FOREIGN PATENT DOCUMENTS

BE 507196 A 12/1951
CN 2475107 Y 1/2002

(Continued)

*Primary Examiner* — Elvin G Enad
*Assistant Examiner* — Malcolm Barnes
(74) *Attorney, Agent, or Firm* — Slater Matsil, LLP

(57) ABSTRACT

A transformer component for setting an inductance and method for manufacturing a transformer component are disclosed. In an embodiment, the transformer component includes a first core part with a middle limb and a second core part with a middle limb, an end side of the middle limb of the first core part and an end side of the middle limb of the second core part being opposite one another. The first core part and the second core part respectively have a bearing area with a respective slope. A width of a gap between the end side of the middle limb of the first core part and the end side of the middle limb of the second core part depends on a position in which the bearing area of the first core part bears against the bearing area of the second core part.

10 Claims, 4 Drawing Sheets

(51) Int. Cl.

| | |
|---|---|
| ***H01F 27/26*** | (2006.01) |
| ***H01F 17/04*** | (2006.01) |
| ***H01F 41/098*** | (2016.01) |
| ***H01F 27/28*** | (2006.01) |
| ***H01F 27/32*** | (2006.01) |
| ***H01F 41/02*** | (2006.01) |

(52) U.S. Cl.
CPC ..... *H01F 27/2823* (2013.01); *H01F 27/325* (2013.01); *H01F 41/0206* (2013.01); *H01F 41/098* (2016.01)

(56) References Cited

U.S. PATENT DOCUMENTS 2,838,737 A * 6/1958 Duncan ..... H01F 17/043 336/120
3,092,796 A 6/1963 Maeda
3,209,294 A * 9/1965 Cornell ..... H01F 29/10 336/134
3,243,745 A * 3/1966 Glover ..... H01F 17/043 174/520
4,523,170 A 6/1985 Huth, III
4,558,295 A * 12/1985 Olmsted ..... H01F 21/06 264/272.19
5,440,225 A * 8/1995 Kojima ..... H01F 3/14 323/359
2004/0056748 A1* 3/2004 Masaki ..... B62D 6/10 336/119
2005/0104703 A1 5/2005 Watanabe et al.
2008/0093966 A1* 4/2008 Li ..... H01F 3/14 313/161
2015/0340147 A1* 11/2015 Pennander ..... H01F 3/14 336/178

FOREIGN PATENT DOCUMENTS

CN 1619722 A 5/2005
CN 101777412 A 7/2010
CN 203179664 U 9/2013
DE 000P0012345DAZ 11/1950
DE 1888682 U 3/1964
DE 3121114 A1 12/1982
DE 4102478 A1 5/1991
GB 751037 A 6/1956
GB 1035378 A 7/1966
JP S51107464 A 9/1976
JP S5724514 A * 2/1982 ..... H01F 17/04
JP S5724514 A 2/1982
JP H0173194 U 5/1989
JP H02194508 A 8/1990
JP H02194508 A * 8/1990 ..... H01F 27/24
JP H0312417 A 1/1991
JP H0312417 U 2/1991
JP H0312417 U * 2/1991 ..... H01F 37/00
JP H05270362 A 10/1993
JP 2005260130 A 9/2005
JP 2005260130 A * 9/2005 ..... H01F 27/24

* cited by examiner

TRANSFORMER COMPONENT WITH SETTING OF AN INDUCTANCE

This patent application is a national phase filing under section 371 of PCT/EP2014/073255, filed Oct. 29, 2014, which claims the priority of German patent application 10 2013 113 481.5, filed Dec. 4, 2013, each of which is incorporated herein by reference in its entirety.

TECHNICAL FIELD

The invention relates to a transformer component with setting of an inductance of the transformer component during the production of the component. The invention also relates to a process for producing a transformer component with setting of an inductance of the transformer during the production process.

BACKGROUND

To avoid core saturation and to establish a certain inductance value in the case of inductive components, solid iron or ferrite cores of transformers and inductors for example are provided with an air gap. The air gap represents an interruption of the magnetic core in the form of a gap and determines the effective permeability $\mu_E$ of the magnetic circuit and also the inductance of the fully assembled inductive component. In order to achieve the desired inductance or permeability, the air gap must have a predefined width within the narrowest possible limits.

An air gap may be subsequently ground into the core after the pressing and sintering. However, it is found with inductive components in which the air gap is ground into the core after the pressing and sintering of the core that different inductance or permeability values occur. The different inductance and permeability values are substantially caused by fluctuations of process parameters during the production process and by slightly different material parameters of the iron or ferrite material used for the core. It is disadvantageous in particular that the grinding of a gap into the core material is a complex operation that involves increased costs.

SUMMARY OF THE INVENTION

Embodiments of the invention specify a transformer component with setting of an inductance of the transformer component in the case of which the inductance can be set in an easy and reliable way at the end of the production process. Further embodiments of the present invention specify a process for producing a transformer component with setting of the inductance of the transformer component by which it is made possible to set the inductance of the transformer component dependably and reliably at the end of the production process.

According to an embodiment, the transformer component comprises a first core part with a middle limb and a second core part with a middle limb. The first core part and the second core part respectively have a bearing area with a respective slope. The bearing area of the first core part bears against the bearing area of the second core part. An end side of the middle limb of the first core part and an end side of the middle limb of the second core part are opposite one another. A width of a gap between the end side of the middle limb of the first core part and the end side of the middle limb of the second core part is dependent on a position in which the bearing area of the first core part bears against the bearing area of the second core part.

According to a further embodiment, a process for producing a transformer component with setting of the inductance comprises providing a first core part, with a middle limb, and a second core part, with a middle limb, the first core part and the second core part respectively having a bearing area. The respective bearing area of the first and second core parts has a slope. The second core part is arranged on the first core part in such a way that the bearing area of the first core part bears against the bearing area of the second core part and an end side of the middle limb of the first core part and an end side of the middle limb of the second core part are opposite one another. The first and second core parts are moved in relation to one another in such a way that the bearing area of the second core part slides on the bearing area of the first core part and a position in which the bearing area of the second core part bears against the bearing area of the first core part is displaced and a width of a gap between the end side of the middle limb of the first core part and the end side of the middle limb of the second core part changes. During the movement of the first and second core parts in relation to one another, an inductance of the transformer component is determined. The moving of the first and second core parts in relation to one another is ended when the inductance determined during the movement assumes a setpoint value.

According to a possible embodiment of the transformer component, the two core parts between which an air gap is to be produced may be provided on the respective bearing areas of the two core parts with in each case at least one spiral or arcuately shaped inclined plane. The inclined plane of the respective bearing area of the two core parts allows an air gap of a variable width to be produced by turning the first and second core parts with respect to one another at a third contact area, in particular between an end face of the end side of the middle limb of the first core part and an end face of the end side of the middle limb of the second core part, since one core half is lifted off from the other core half by the turning of the two core parts.

Consequently, in the case of the specified transformer component or during the production process, the air gap, and consequently the permeability or inductance, of the transformer can be set steplessly. As a result, with identical core blanks, any desired inductance values can be produced in the final assembly of the transformer component. It is not necessary to keep various predefined core blanks in stock.

In principle, the inductance or permeability of a transformer component is dependent on fluctuations of the process parameters during the production process, for example on the type of sintering, on the material parameters of the materials used for the core and on geometrical parameters, for example of the form of the core. The geometrical parameters also include the width of the air gap between the two core halves. The width of the air gap has a major influence on the permeability or inductance of the finished component. Since the width of the air gap can be set during the final assembly of the magnetic component by the cores themselves, it is possible to compensate for dimensional and process fluctuations and fluctuations of the material parameters of the materials used and of a wire coil of the transformer through to fluctuations of the numbers of turns of the wires of the wire winding of the transformer.

The so-called air gap does not necessarily have to contain air. As explained at the beginning, the term "air gap" refers to any interruption in the core by which the magnetic flux is interrupted. As a difference from processes for producing an air gap in a magnetic circuit in which the air gap is set by placing additional non-magnetic material, such as for example paper or plastic, into the gap between the core limbs as a spacer with the desired thickness of the air gap, it is not necessary in the case of the specified transformer component or production process to use additional materials, which are possibly affected by tolerances in the thickness of the materials, so that the effort involved in production and the costs to be expended on production turn out to be low.

As a difference from a process in which the air gap is set by at least one of the limbs, for example in the case of E cores the middle limb, usually being shortened by a laborious and separate grinding of the limb halves, the cost-intensive grinding of the cores is not required in the case of the process according to the invention. The cores do not have to be worked already before the final assembly of the component by grinding down material on one limb.

In comparison with transformer components and the associated production processes in the case of which a magnetically conductive adjusting screw is additionally screwed into the gap between the middle limb of two core halves as a means of partially bridging the air gap for the exact adjustment of the inductance, in particular for the subsequent setting of the air gap, the use of additional materials, for example the use of spacers or an adjusting screw, in the air gap is not required in the case of the transformer component according to the invention or the production process. Consequently, the transformer component is not unnecessarily increased in size by the additional materials and the effort involved in assembly and the costs associated with assembly are low.

In addition, the transformer component is not affected by a reduction of the core saturation, which occurs when using an adjusting screw through the middle hole necessary for it in the middle limb. In comparison with a UV adhesive method, in which an adhesive with UV curing cures after a defined measurement of the inductance, a greater width of the air gap can be realized with the specified transformer component or the production process. It may be possible in comparison with the UV adhesive method to dispense entirely with the use of a UV adhesive between the bearing areas of the first and second core parts and for only a standard core-core adhesion to be required, when the position of the two core parts cannot change until the curing of the adhesive takes place.

BRIEF DESCRIPTION OF THE DRAWINGS

The invention is explained in more detail below on the basis of figures that show exemplary embodiments of the present invention and in which.

DETAILED DESCRIPTION OF ILLUSTRATIVE EMBODIMENTS

Figure 1:
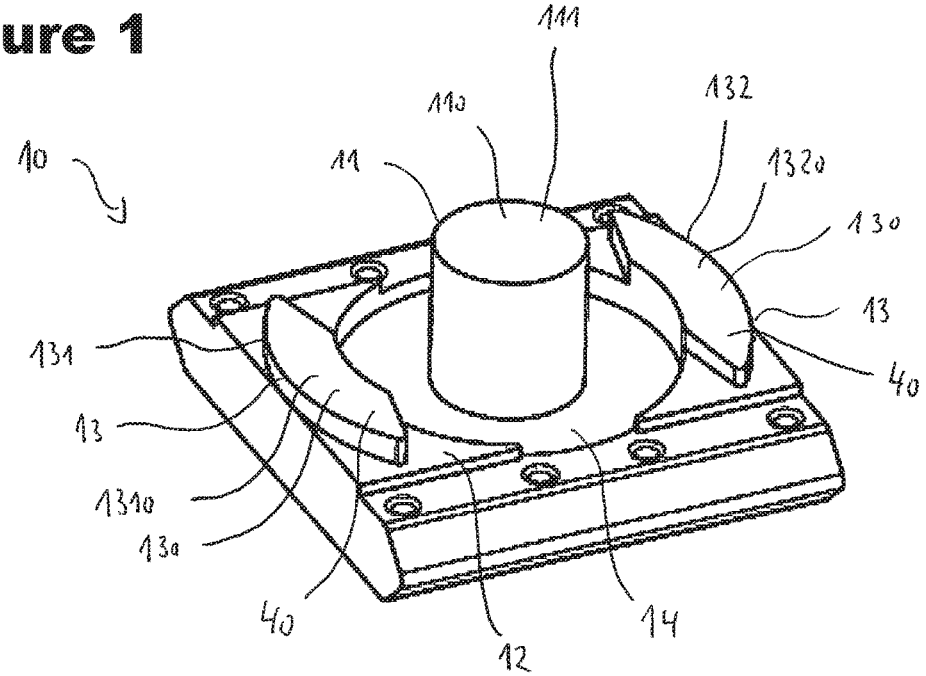
FIG. 1 shows an embodiment of a first core part of a transformer component with stepless setting of the inductance.

FIG. 1 shows an embodiment of a first core part 10 of a transformer component with stepless setting of the inductance. The first core part 10 has a middle limb 11. The middle limb 11 may be formed as a cylindrical rod core of the transformer. The first core part 10 also comprises a bearing area 130 with a slope. The bearing area is designed for bearing on a bearing area of a further core part of the transformer component. The middle limb 11 of the first core part 10 has an end face 111 on an end side 110. The bearing area 130 of the first core part 10 is formed as an inclined plane with the slope mentioned with respect to the end face 111 of the middle limb 11 of the first core part 10. The slope of the bearing area 130 with respect to the end face 111 may be for example between 0.1° and 5°, preferably 2°.

The first core part 10 also has an area 12, from which a raised structure 13 protrudes. The bearing area 130 of the first core part 10 is formed as a surface of the raised structure 13. According to a possible embodiment, the raised structure 13 may have at least a first projection 131 and a second projection 132. The first and second projections 131, 132 may protrude from the area 12 of the first core part 10 on two opposite sides of the middle limb 11.

A first part of the bearing area 130 of the first core part 10 is formed as a surface 1310 of the first projection 131. A second part of the bearing area 130 of the first core part 10 is formed as a surface 1320 of the second projection 132. The surface 1310 of the first projection 131, which forms the first part of the bearing area 130 of the first core part 10, and the surface 1320 of the second projection 132, which forms the second part of the bearing area 130 of the first core part 10, are respectively shaped in the form of a segment of a circular ring.

The first core part 10 may also have an area 14 shaped in the form of a circular ring, from which the middle limb 11 of the first core part 10 protrudes. The area 14 shaped in the form of a circular ring may be formed for example as a depression in the area 12 of the first core part 10. The middle limb 11 may be arranged in the center of the circular area 14. The middle limb 111 protrudes from the area 14 further than the projections 131, 132 protrude from the area 12. The projections 131, 132 consequently have a smaller height than the middle limb 111.

Figure 2:
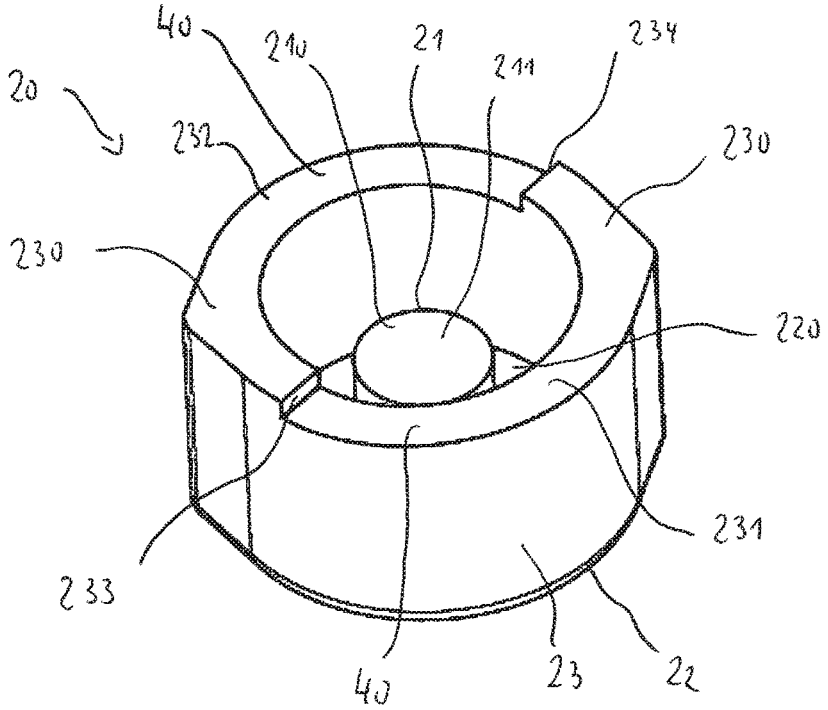
FIG. 2 shows an embodiment of a second core part of a transformer component with stepless setting of the inductance.

FIG. 2 shows an embodiment of a second core part 20 of the transformer component with stepless setting of the inductance. The second core part 20 comprises a middle limb 21. In addition, the second core part 20 has a bearing area 230 with a slope. The bearing area 230 is designed to bear against the bearing area 130 when the core part 20 is arranged on the core part 10. The middle limb 21 of the second core part 20 has an end face 211 on an end side 210. The bearing area 230 of the second core part 20 is formed as an inclined plane with the slope mentioned with respect to the end face 211 of the middle limb 21. The bearing area 230 of the second core part 20 may for example have a slope of between 0.1° and 5°, preferably 2°, with respect to the end face 211.

According to a possible embodiment, the second core part 20 may have a bottom part 22 and at least one side wall 23, which is arranged on an area 220 of the bottom part. The middle limb 21 of the second core part 20 is arranged on the area 220 of the bottom part 22 and is at least partially surrounded by the at least one side wall 23. The bearing area 230 is arranged on a side of the at least one side wall 23 that is opposite from the bottom part 22. The bearing area 230 may be formed as a surface of the at least one side wall 23 that is shaped in the form of an arc or in the form of a circular ring. The bearing area 230 may for example have at least two surfaces of the at least one side wall 23 that rise up in the form of an arc or in the form of a semicircle.

In the case of the embodiment shown in FIG. 2, the core part 20 is formed as a cap, and consequently as a hollow body that is open to one side. A cavity of the hollow body is bounded by the bottom part 22 and the at least one side wall 23. In the interior of the cavity, the middle limb 21 projects up from the bottom part 22. The middle limb 21 has a smaller height than the at least one side wall 23.

According to a possible embodiment, the bearing area 230 of the second core part 20 has a first inclined plane 231, which is inclined with respect to a plane of the end face 211 of the middle limb 21, and a second inclined plane 232, which likewise has an inclination with respect to the end face 211 of the middle limb 21. The bearing area 230 has a first offset 233 and a second offset 234. The first inclined plane 231 of the bearing area 230 rises up in the form of a circular ring from the first offset 233 to the second offset 234. The first inclined plane 231 of the bearing area 230 may be shaped as a first segment of a circular ring and rises up from the first offset 233 to the second offset 234. The second inclined plane 232 rises up in the form of a circular ring from the second offset 234 to the first offset 233. The second inclined plane 232 may be shaped as a second segment of the circular ring and rise up from the second offset to the first offset.

Figure 3:
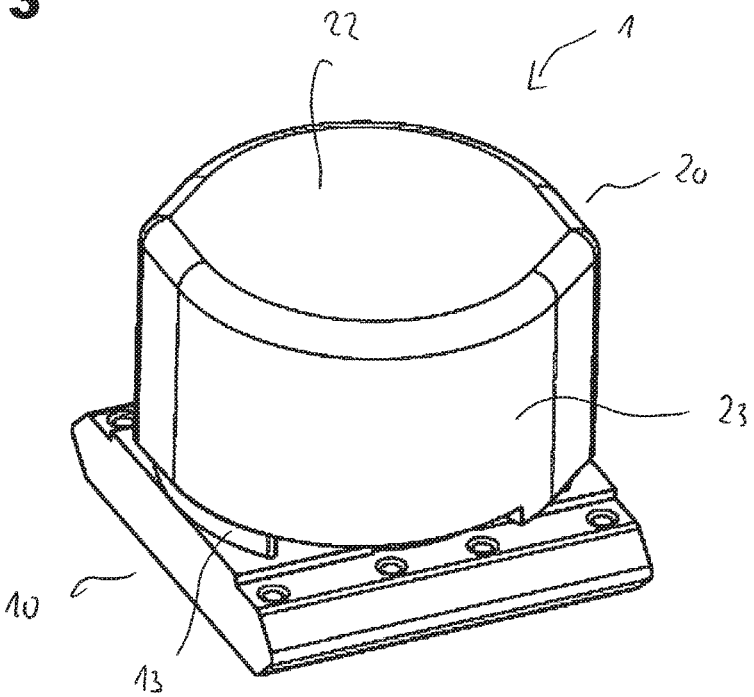
FIG. 3 shows a perspective view of an embodiment of a transformer component with stepless setting of the inductance.
Figure 4A:
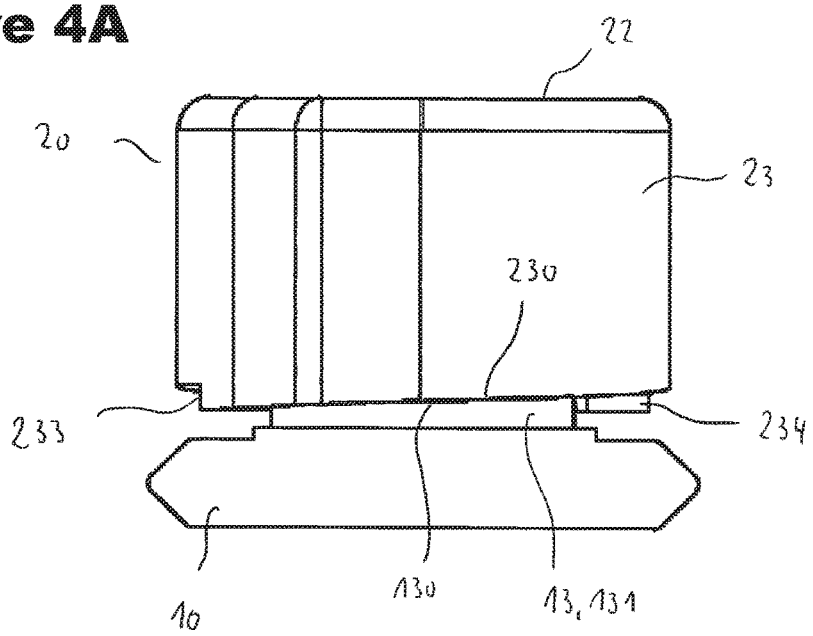
FIG. 4A shows a view of an embodiment of a transformer component with stepless setting of the inductance from one side.
Figure 4B:
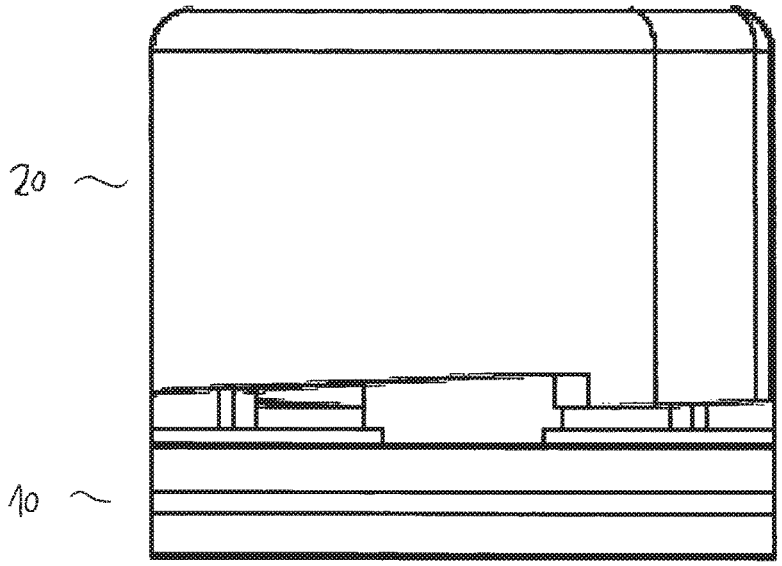
FIG. 4B shows a view of an embodiment of a transformer component with stepless setting of the inductance from another side.

For the assembly of the transformer component, the second core part 20, shaped as a cap, is placed onto the core part 10. FIG. 3 shows in a perspective view the transformer component 1 after arranging the core part or the cap 20 on the core part 10. FIG. 4A shows a view of the transformer component 1 of FIG. 3 from a first side. FIG. 4B shows the transformer component 1 of FIG. 3 from a second side.

After the placing together of the first and second core parts 10, 20, the bearing area 130 of the first core part 10 bears against the bearing area 230 of the second core part 20. In this case, the end side 110 of the middle limb 11 of the first core part 10 and the end side 210 of the middle limb 21 of the second core part 20 are opposite one another. In particular, the end face 111 of the middle limb 11 of the first core part 10 and the end face 211 of the middle limb 21 of the second core part 20 are opposite one another. Depending on a position in which the bearing area 130 of the first core part 10 bears against the bearing area 230 of the second core part 20, a gap 30 with a specific width is produced between the end side 110 of the middle limb 111 and the end side 210 of the middle limb 21.

Figure 5A:
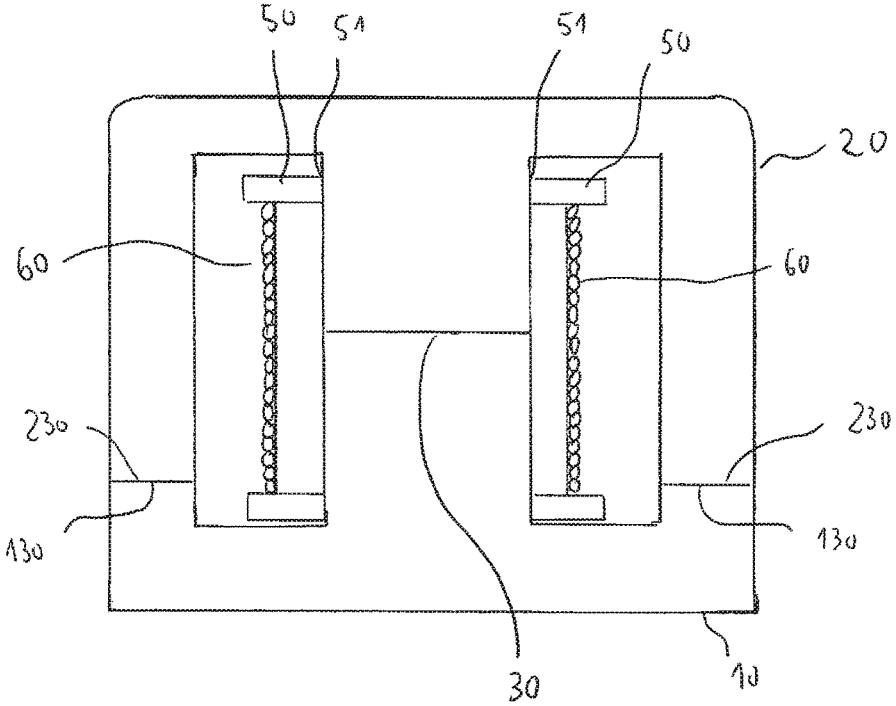
FIG. 5A shows an inner cross section of an embodiment of a transformer component with stepless setting of the inductance, with a first set gap width.
Figure 5B:
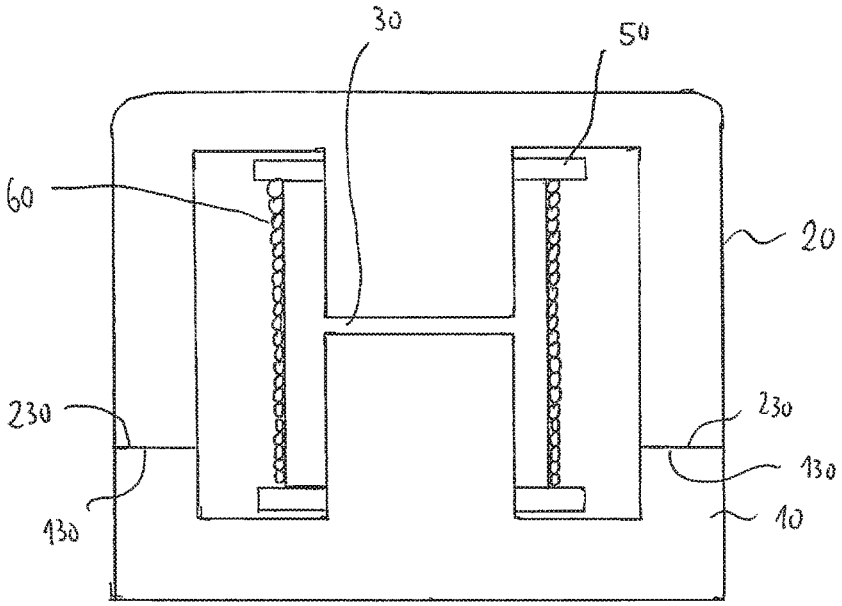
FIG. 5B shows an inner cross section of an embodiment of a transformer component with stepless setting of the inductance, with a second set gap width.

FIGS. 5A and 5B respectively show an inner cross section of the transformer component 1 with the first core part 10 and the second core part 20, the second core part 20 being arranged on the first core part 10, so that the end side 110 of the middle limb 111 and the end side 210 of the middle limb 21 are opposite one another. Arranged on the middle limb 11 of the first core part 10 and the middle limb 21 of the second core part 20 is a coil former 50 with a wire winding 60. The two core halves 10 and 20 may be fixed to one another by an adhesive layer 40, which is shown in FIGS. 1 and 2 and has been applied on the bearing area 130 of the first core part 10 and/or on the bearing area 230 of the second core part 20.

The inductance or permeability of the transformer component 1 is dependent not only on the process parameters of the production process but also on the material parameters of the materials used, in particular the materials of the core halves 10, 20, the material of the wire used for the wire winding 60, the number of turns, and the geometrical parameters, in particular the width of the air gap between the end side 110 of the middle limb 11 and the end side 210 of the middle limb 21. With the transformer component 1, the inductance or permeability of the component can be set steplessly at the end of the production process.

For this purpose, for example, first the coil former 50 wound with the wire winding 60 is arranged on the first core part 10. The coil former 50 may for example have a hollow tube 51, in which the middle limb 11 of the first core part 10 is arranged. After the arrangement of the coil former 50 with the wire winding 60 on the middle limb 11, the wire winding is contacted at external contact terminals of the core part 10.

The adhesive coating 40 is applied to at least one of the bearing areas 130, 230 of the first and second core parts 10, 20. After that, the second core part 20 is arranged on the first core part 10 in such a way that the bearing area 130 of the first core part 10 bears against the bearing area 230 of the second core part 20. Furthermore, after the arrangement of the second core part 20 on the first core part 10, the end side 110 of the middle limb 11 of the first core part 10 and the end side 210 of the middle limb 21 of the second core part 20 are opposite one another. In this case, a width of the gap 30 between the end side 110 of the middle limb 11 of the first core part 10 and the end side 210 of the middle limb 21 of the second core part 20 is dependent on a position in which the bearing area 130 of the first core part 10 bears against the bearing area 230 of the second core part 20.

After the placement of the second core part 20 on the first core part 10, the first and second core parts 10, 20 are moved in relation to one another in such a way that the bearing area 230 of the second core part 20 slides on the bearing area 130 of the first core part 20. As this happens, a position in which the bearing area 230 of the second core part 20 bears against the bearing area 130 of the first core part 10 is displaced. Since the bearing area 130 of the first core part 10 has a slope with respect to the end face 111 of the middle limb 11 and the bearing area 230 of the second core part 20 has a slope with respect to the end face 211 of the middle limb 21 of the second core part 20, the movement of the first and second core parts 10, 20 with respect to one another has the effect that the width of the gap 30 between the end side 110 of the middle limb 11 and the end side 210 of the middle limb 21 changes.

Since the wire winding 60 is contacted at contact terminals of the core part 10, an inductance of the transformer component 1 can be determined during the movement of the first and second core parts 10, 20 by the external contact terminals of the transformer component being connected to a suitable measuring device for measuring the inductance. The first and second core parts 10, 20 may be moved with respect to one another during the measuring of the inductance of the transformer component until the inductance of the transformer component that is determined during the movement assumes a setpoint value.

In the case of the embodiment shown in FIG. 5A, the bearing area 230 of the second core part 20 bears against the bearing area 130 of the first core part 10 in such a way that a gap width of the air gap 30 is virtually 0 mm. In the case of the embodiment shown in FIG. 5B, the second core part 20 has been displaced with respect to the first core part 10 in comparison with the position shown in FIG. 5A in such a way that the width of the air gap 30 between the end side 110 of the middle limb 11 and the end side 210 of the middle limb 21 has increased. As a result, the inductance and the permeability of the inductive transformer component have changed in comparison with the position of the two core parts 10, 20 in FIG. 5A.

When the measured inductance assumes the desired setpoint value during the movement of the second core part 20 on the first core part 10, the moving of the first and second core parts 10, 20 in relation to one another is ended. The adhesive coating 40, which has been applied to the bearing area 130 of the first core part 10 and/or to the bearing area 230 of the second core part 20, is cured in this position, so that the two core halves are fixed to one another in this position in which the inductance of the transformer component corresponds to the setpoint value.

According to a possible embodiment of the production process, the first core part 10 is provided, with the area 12, from which the raised structure 13 protrudes, the bearing area 130 being formed as a surface of the raised structure 13 and the raised structure 13 having at least a first and a second projection 131, 132, which protrude from the area 12 of the first core part 10 on two opposite sides of the middle limb 11 of the first core part 10. A first part of the bearing area 130 of the first core part 10 is formed as a surface 1310 of the first projection 131. A second part of the bearing area 130 is formed as a surface 1320 of the second projection 132. The first core part 10 is provided during the production process in such a way that the surface 1310 of the first projection 131 that forms the first part of the bearing area 130 of the first core part 10 and the surface 1320 of the second projection 132 that forms the second part of the bearing area 130 of the first core part 10 are respectively shaped in the form of a segment of a circular ring.

The second core part 20 is provided, with the bottom part 22 and the at least one side wall 23, which is arranged on the area 220 of the bottom part 22. The middle limb 21 of the second core part 20 is arranged on the area 220 of the bottom part 22 of the second core part 20 and is at least partially surrounded by the at least one side wall 23. Furthermore, the second core part 20 is provided in such a way that the bearing area 230 of the second core part 20 is arranged on a side of the at least one side wall 23 that is opposite from the bottom part 22. The bearing area 230 may have at least two rising surfaces of the at least one side wall 23 that are shaped in the form of an arc or in the form of a circular ring.

In the case of this embodiment, the moving of the first and second core parts 10, 20 in relation to one another takes place by a turning of the first and second core parts 10, 20 with respect to one another. The width of the gap 30 between the end side 110 of the middle limb 11 of the first core part 10 and the end side 210 of the middle limb 21 of the second core part 20 is changed as a result of the rotational movement until the inductance of the transformer component measured during the turning assumes the desired setpoint value. If the measured inductance is for example too low, the two core parts 10, 20 are moved with respect to one another in such a way that the width of the gap 30 is reduced until the measured inductance value corresponds to the setpoint value. If, conversely, the measured inductance is too high with respect to the setpoint value of the inductance, the first and second core parts 10, 20 are moved with respect to one another in such a way that the width of the air gap between the middle limb 11 and the middle limb 21 is increased. When the setpoint value is reached, the rotational movement is ended and the initially still liquid adhesive 40 between the bearing area 130 and the bearing area 230 cures.

With the specified transformer component 1 or the specified production process, a sought inductance or permeability value of the transformer component can be reliably set in an easy way without prior air-gap grinding of the core halves 10, 20 and without the use of additional materials. As a result, the fluctuations of the inductance or permeability value that usually occur during the production of a large number of transformer components and are caused by fluctuations of the process parameters of the production process or by fluctuations of the material parameters of the core parts 10, 20 can be compensated, so that the transformer components produced have virtually the same inductance or permeability value.

The invention claimed is:

1. A transformer component for setting an inductance, the transformer component comprising:

a first core part with a middle limb; and a second core part with a middle limb;

wherein the first core part and the second core part respectively have a bearing area with a respective slope, wherein the bearing area of the first core part bears against the bearing area of the second core part, wherein an end side of the middle limb of the first core part and an end side of the middle limb of the second core part being opposite one another;

wherein a width of a gap between the end side of the middle limb of the first core part and the end side of the middle limb of the second core part being dependent on a position in which the bearing area of the first core part bears against the bearing area of the second core part;

wherein the first core part has a raised structure protruding from a first area of the first core part;

wherein the bearing area of the first core part is a surface of the raised structure;

wherein the raised structure has at least a first projection and a second projection, and wherein each of the first projection and the second projection protrude from the first area of the first core part on two opposite sides of the middle limb;

wherein a first part of the bearing area of the first core part is a surface of the first projection and a second part of the bearing area of the first core part is a surface of the second projection;

wherein the first part of the bearing area of the first core part and the second part of the bearing area of the first core part are each shaped in a form of a segment of a circular ring, wherein the bearing area of the second core part has a first inclined plane and a second inclined plane which are respectively inclined with respect to a plane of an end face of the middle limb of the second core part;

wherein the surface of the first projection of the first core part bears against a surface of the first inclined plane of the second core part, wherein the surface of the first projection is smaller than the surface of the first inclined plane; and wherein the surface of the second projection of the first core part bears against a surface of the second inclined plane of the second core part, wherein the surface of the second projection is smaller than the surface of the second inclined plane.

2. The transformer component according to claim 1, wherein the respective slope of the bearing area of the first and second core parts are between 0.1° and 5°, respectively.

3. The transformer component according to claim 1, wherein the middle limb of the first core part and the middle limb of the second core part respectively have an end face on their respective end side, wherein the end face of the middle limb of the first core part and the end face of the middle limb of the second core part are opposite one another, wherein the bearing area of the first core part is formed as an inclined plane with the slope with respect to the end face of the middle limb of the first core part, and wherein the bearing area of the second core part is formed as an inclined plane with the slope with respect to the end face of the middle limb of the second core part.

4. The transformer component according to claim 1, wherein the first core part has an area shaped in a form of a circular ring, from which the middle limb of the first core part protrudes, and wherein the area shaped in the form of a circular ring is formed as a depression in the area of the first core part.

5. The transformer component according to claim 1, wherein the second core part has a bottom part and at least one side wall, which is arranged on an area of the bottom part, wherein the middle limb of the second core part is arranged on the area of the bottom part of the second core part and is at least partially surrounded by the side wall, wherein the bearing area of the second core part is arranged on a side of the at least one side wall that is opposite from the bottom part, and wherein the bearing area has at least two surfaces of the at least one side wall that are respectively shaped as segments of a circular ring.

6. The transformer component according to claim 5, wherein the second core part is formed as a hollow body that is open to one side, with a cavity which is bounded by the bottom part and the at least one side wall.

7. The transformer component according to claim 1, wherein the bearing area of the second core part has a first and a second offset, wherein the first inclined plane of the bearing area of the second core part is shaped as a first segment of a circular ring and rises up from the first offset to the second offset, and wherein the second inclined plane of the bearing area of the second core part is shaped as a second segment of the circular ring and rising up from the second offset to the first offset.

8. The transformer component according to claim 1, wherein an adhesive layer is arranged between the bearing area of the first core part and the bearing area of the second core part.

9. The transformer component according to claim 1, further comprising:

a coil former with a wire winding; and the coil former being arranged on the middle limb of the first core part and the middle limb of the second core part.

10. A transformer component for setting an inductance, the transformer component comprising:

a first core part with a middle limb;

a second core part with a middle limb; and a coil former with a wire winding, wherein the first core part and the second core part each have a bearing area with a respective slope;

wherein the bearing area of the first core part bears against the bearing area of the second core part;

wherein an end side of the middle limb of the first core part and an end side of the middle limb of the second core part being opposite one another;

wherein a width of a gap between the end side of the middle limb of the first core part and the end side of the middle limb of the second core part being dependent on a position in which the bearing area of the first core part bears against the bearing area of the second core part;

wherein the coil former is arranged on the middle limb of the first core part and the middle limb of the second core part;

wherein the first core part has a raised structure protruding from a first area of the first core part;

wherein the bearing area of the first core part is a surface of the raised structure;

wherein the raised structure has at least a first projection and a second projection, and wherein each of the first projection and the second projection protrude from the first area of the first core part on two opposite sides of the middle limb;

wherein a first part of the bearing area of the first core part is a surface of the first projection and a second part of the bearing area of the first core part is a surface of the second projection;

wherein the first part of the bearing area of the first core part and the second part of the bearing area of the first core part are each shaped in a form of a segment of a circular ring;

wherein the bearing area of the second core part has a first inclined plane and a second inclined plane which are respectively inclined with respect to a plane of an end face of the middle limb of the second core part;

wherein the surface of the first projection of the first core part bears against a surface of the first inclined plane of the second core part, wherein the surface of the first projection is smaller than the surface of the first inclined plane; and wherein the surface of the second projection of the first core part bears against a surface of the second inclined plane of the second core part, wherein the surface of the second projection is smaller than the surface of the second inclined plane.

* * * * *